US005998874A

United States Patent [19]

Huber et al.

[11] Patent Number: 5,998,874

[45] Date of Patent: Dec. 7, 1999

[54] ULTRAHIGH DENSITY CHARGE TRANSFER DEVICE

[75] Inventors: Carmen I. Huber, Silver Spring, Md.; Tito E. Huber, Brooklyn, N.Y.; Nicholas Caviris, Rockville, Md.

[73] Assignee: The United States of America as represented by the Secretary of the Navy, Washington, D.C.

[21] Appl. No.: 08/322,670

[22] Filed: Oct. 13, 1994

Related U.S. Application Data

[62] Division of application No. 08/059,766, May 11, 1993, Pat. No. 5,421,396.

[51] Int. Cl.[6] ..... H01L 23/48; G02F 1/00

[52] U.S. Cl. ..... 257/774; 257/746; 257/686; 257/777; 359/245; 359/254; 359/295

[58] Field of Search ..... 257/774, 777, 257/686, 746; 359/295, 254, 245

[56] References Cited

U.S. PATENT DOCUMENTS 4,499,655 2/1985 Anthony ..... 257/774
4,946,592 8/1990 Galaj et al. ..... 210/490
5,087,278 2/1992 Suzuki ..... 55/223
5,287,215 2/1994 Warde et al. ..... 359/293

OTHER PUBLICATIONS

Warde et al, *Applied Optics* vol. 31 No. 20 Jul. 10, 1992 pp. 3971–3979 "Charge—transfer—plate spatial light modulators".

*Primary Examiner*—Jerome Jackson, Jr.
*Attorney, Agent, or Firm*—John Forrest; Jacob Shuster

[57] ABSTRACT

Metal heated to a molten state is injected under a high hydrostatic penetration pressure into extremely small and closely spaced channels of an insulating matrix to form an array of electrically conductive pins or wires. The materials for the pins and matrix are selected for compatibility with respect to melting, matrix sintering and surface tension penetration conditions associated with the fabrication of a high density charge transfer device.

10 Claims, 3 Drawing Sheets

ULTRAHIGH DENSITY CHARGE TRANSFER DEVICE

This application is a division of application Ser. No. 08/059,766 filed May 11, 1993, now U.S. Pat. No. 5,421,396

BACKGROUND OF THE INVENTION

This invention relates generally to charge transfer devices embodied in electronic components for multi-feedthrough purposes.

Charge transfer plates as presently well known are utilized for multi-feedthrough transfer of two-dimensional distributed charges in microelectronic devices. Such charge transfer plates are embodied in spatial light modulators associated with optical information processing systems, for example, as more recently disclosed in an article by Cardinal Warde et al., entitled "Charge-transfer-plate Spatial Light Modulators", published in the Jul. 10, 1992 issue (Vol. 31, No. 20) of "Applied Optics".

Despite the recognized advantages of charge transfer plates, certain disadvantages arise from use thereof, such as Loss of spatial resolution. Improvement in spatial resolution is Limited by current technology to a maximum charge transfer density of 900,000 conductor pins per square centimeter of the insulating matrix plate area.

Accordingly, it is an important object of the present invention to provide a charge transfer plate device which will effectively improve spatial resolution by a large increase in charge transfer density. Pursuant to the foregoing objective, it is another object of the present invention to provide a high density array of nanometer size, electrically insulated, conducting wires for transmission of electric charges and/or simultaneous transfer of multiple electrical signals.

SUMMARY OF THE INVENTION

In accordance with the present invention, the number of conductive pins within the embedded plate area of the insulating matrix of a charge transfer device is increased substantially above 900,000 pins per square centimeter of plate area to a maximum pin density of 10 billion, by correspondingly closer spacing between and reduction in the diameters of the matrix channels and the electrically conductive pins or wires occupying such channels. Such reduced spacing and diameters of the channels and pins is achieved by use of a fabrication method involving the melting of metal, injection of the molten metal under a high hydrostatic pressure to penetrate the matrix plate and cooling of the plate to solidify the molten metal into the pins occupying the channels therein.

In order to meet operational conditions of the fabrication method, a selection is made of compatible materials for the metallic pins and insulating matrix, respectively having a relatively low melting temperature and a higher sintering temperature. Also, the interrelationship between the selected materials is such that the injection pressure overcomes the surface tension developed between the molten metal and the matrix plate surface being penetrated.

BRIEF DESCRIPTION OF DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENT

Figure 1:
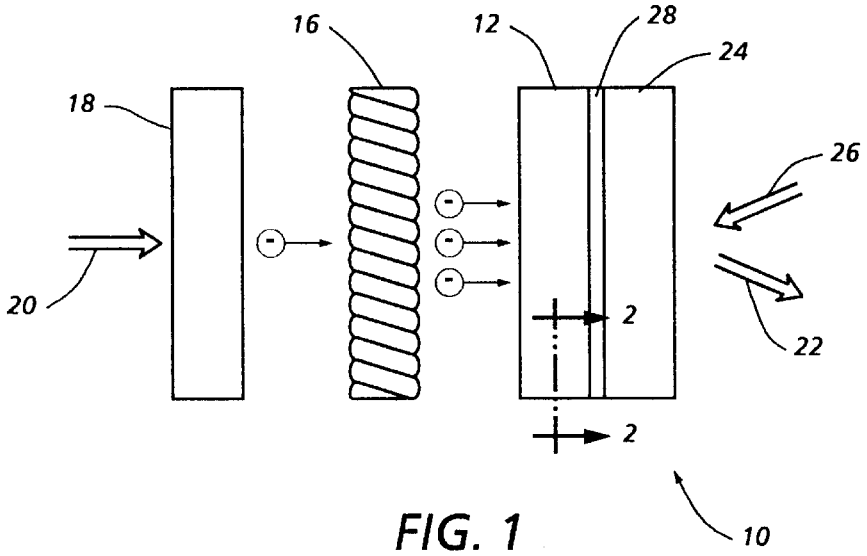
FIG. 1 is a side elevation view of a disassembled spatial light modulator embodying a charge transfer device constructed in accordance with the present invention.

Referring now to the drawing in detail, FIG. 1 illustrates the disassembled parts of a spatial light modulator 10 embodying therein a charge transfer device generally referred to by reference number 12 in accordance with one embodiment of the present invention. The charge transfer device 12 is interfaced between a light modulator element 24 and a gain element 16 through which an electronic output from a charge generation element 18 is multiplied. The element 18 receives its input, in the form of illumination by write beam 20, to produce a modulated light output 22 from the light modulator 24 in response to impingement thereon by readout light 26. A dielectric mirror layer 28 may be interfaced between the modulator 24 and the charge transfer device 12 as shown in FIG. 1.

Figure 2:
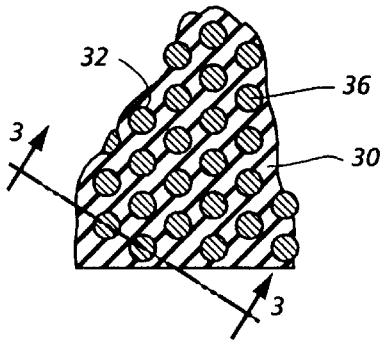
FIG. 2 is a highly magnified section view of a portion of the charge transfer device, taken substantially through a plane indicated by section line 2—2 in FIG. 1.
Figure 3:
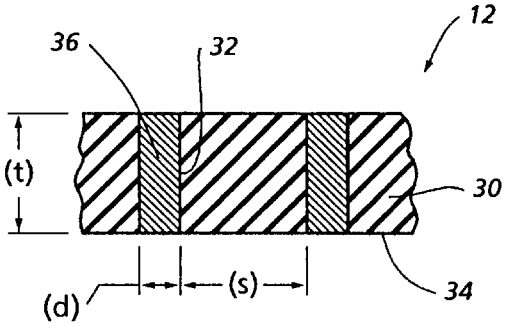
FIG. 3 is an enlarged partial section view taken substantially through a plane indicated by section line 3—3 in FIG. 2.

FIGS. 2 and 3 show in greater detail the construction of the charge transfer device 12, which includes a generally planar, electrically insulating matrix 30 having a thickness (t) of 55 microns, for example, and made of alumina. An array of channels 32 are formed in the plate matrix 30 in generally parallel spaced relation to each other, extending substantially perpendicular to the plate surface 34. Embedded in the matrix 30 within each channel 32 is an electrically conductive wire pin 36 made of a metal such as indium.

Pursuant to the present invention, each of the diameters (d) of the pins or channels and the spacings (S) therebetween are extremely small (as low as 20 nanometers corresponding to a cross-sectional charge transfer density of 10 billion pins per square centimeter of plate area). In an actual constructed embodiment, for example, the diameters (d) and spacings (S) are 200 nanometers corresponding to a charge transfer density of one billion pins per square centimeter, substantially exceeding a density of 900,000 pins per square centimeter heretofore deemed maximum under current technology, based on pin diameters of 10 microns and pin spacings of 4 microns. In order to achieve such virtually microscopic dimensional limitations for the pins 36 and the spacing therebetween in the charge transfer device 12, a special manufacturing procedure was utilized pursuant to the present invention as diagrammed in FIG. 4.

Figure 4:
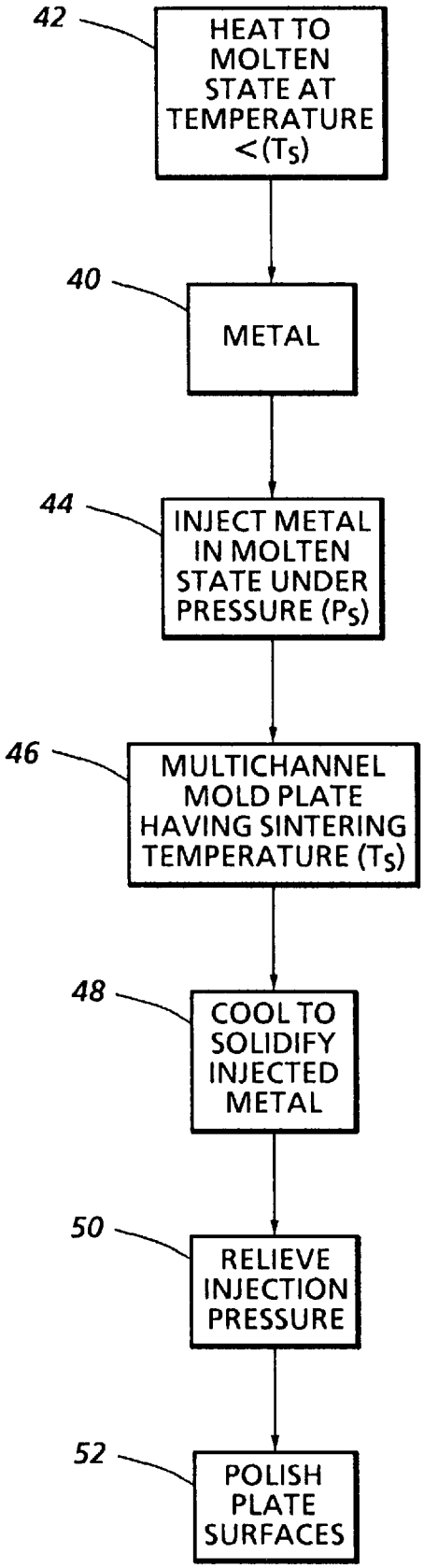
FIG. 4 is a block diagram depicting the fabrication method utilized to construct a charge transfer device as shown in FIGS. 1, 2, and 3.

With reference to FIG. 4, a selected electrically conductive metal as denoted by block 40, is heated to a melting temperature less than (Ts) as denoted by block 42. The metal in a molten state is then injected under a hydrostatic pressure (Ps) (such as 60,000 lbs. per square inch) as denoted by block 44, into the matrix 30 hereinbefore described, constituting the multi-channel mold plate indicated by block 46 in FIG. 4. The molten metal accordingly fills the plate channels 32 so that when the plate is cooled below the metal melting temperature, the metal solidifies into the pins 36 as denoted by block 48. The injection pressure exerted on the plate and metal is then relieved, as denoted by block 50. The surfaces of the plate with the pins embedded therein may then be polished as denoted by block 52.

The selection of metal for the pins 36 and the insulating matrix material for plate 30 is such that the metal melting temperature is less than the sintering temperature (Ts) of the plate at which the channels 32 collapse. Further, such selection of materials is limited by the requirement that the molten metal injection pressure (Ps) is sufficient to overcome the surface tension developed between the molten metal and the plate matrix 30. Indium as the metal and alumina as the insulating plate matrix material have been found to meet the foregoing condition requirements of the present invention including the sintering temperature (Ts) and injection pressure (Ps).

Figure 5:
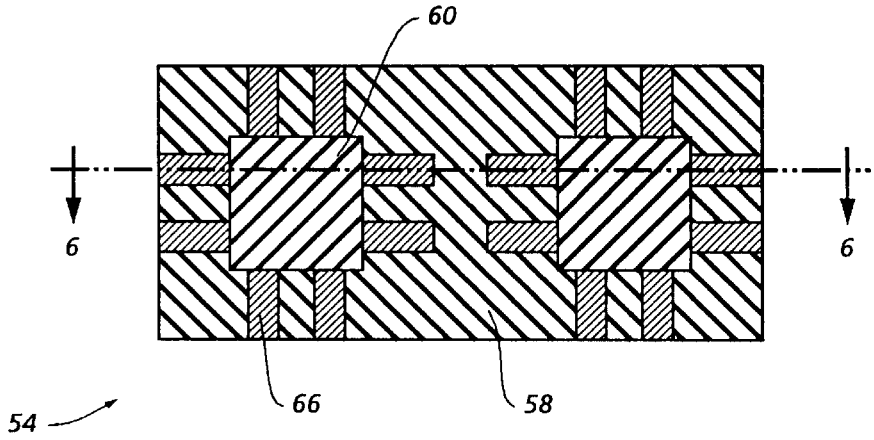
FIG. 5 is a top section view through an electrical multi-feedthrough assembly as another installational embodiment of the present invention.
Figure 6:
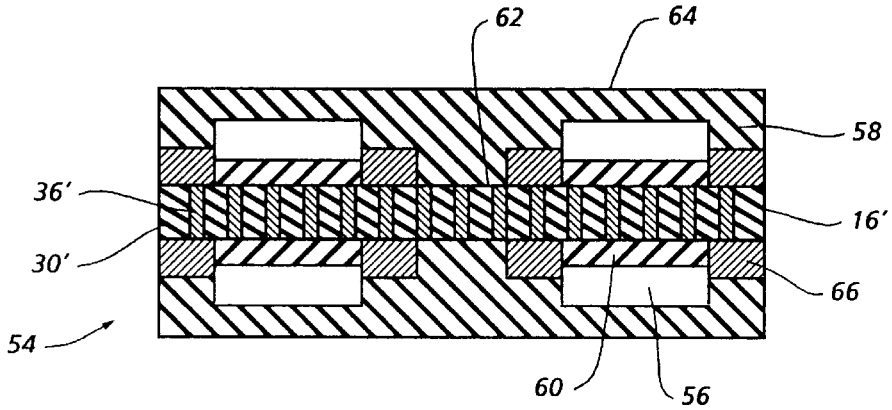
FIG. 6 is a side section view taken substantively through a plane indicated by section line 6—6 in FIG. 5.

FIGS. 5 and 6 illustrate another installational embodiment of the present invention, other than the spatial light modulator type of electronic device 10 shown in FIGS. 1–3. An electrical multifeedthrough assembly 54 is shown for simultaneous transfer of electrical signals between sets of coplanar integrated circuit chips 56. Each of the circuit chips 56 in a set is mounted in a common insulator body 58 and is covered by an insulator pad 60 exposed in a planar face 62 on one side of the body 58 opposite face 64 from which the chips 56 are spaced. Electrically conductive input lines 66 extend from each circuit chip 56 and are exposed in the plane of face 62 of its insulator body 58 as shown. Insulator bodies 58 respectively mounting adjacent sets of coplanar chips 56 are operatively interconnected for parallel charge transfer operation through the wires of a charge transfer plate 16' interfaced between the faces 62 of the adjacent insulator bodies 58. With the input lines 66 being micron size, pursuant to current integrated circuit chip technology and the individual wires 36' in the insulating matrix 30' of the charge transfer plate 16' having a maximum diameter of 200 nanometers, each input line 66 oversamples many wires 36' in the charge transfer plate 16'.

Figure 7:
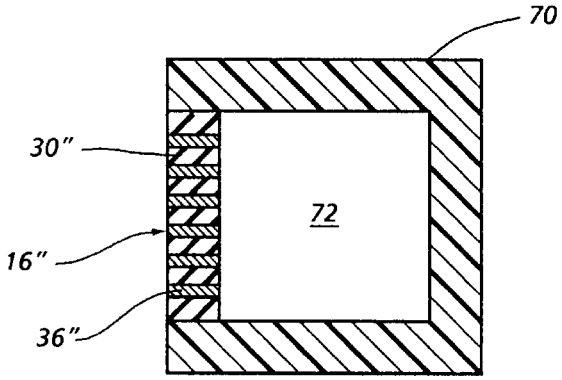
FIG. 7 is a side section view illustrating yet another installational embodiment of the present invention.

According to yet another installational embodiment as shown in FIG. 7, a charge transfer plate 16", also constructed as hereinbefore described, is mounted in the opening of an enclosure 70 to hermetically seal therein a vacuum chamber 72 as the environment to which simultaneous transfer of electrical signals is effected. Since the construction of the charge transfer plate 16" results in a vacuum-tight seal between the metal wires 36" and insulating matrix 30", gas molecules cannot diffuse into the vacuum chamber 72 during multifeedthrough operation of the charge transfer device.

Numerous other modifications and variations of the present invention are possible in light of the foregoing teachings. It is therefore to be understood that within the scope of the appended claims the invention may be practiced otherwise than as specifically described.

What is claimed is:

1. In an electronic device having a high density charge transfer plate made of an electrically insulating material and an array of electrically conductive pins embedded therein, the improvement residing in said pins being spaced from each other and having diameters dimensionally providing a cross-sectional charge transfer density substantially exceeding 900,000 pins per square centimeter.

2. The high density charge transfer plate as defined in claim 1 wherein said electrically insulating material is alumina and the pins are made of indium.

3. The high density charge transfer plate as defined in claim 2 wherein said diameters of the pins and spacing therebetween is as low as 20 nanometers corresponding to approximately 10 billion pins per square centimeter as the charge transfer density.

4. The high density charge transfer plate as defined in claim 1 wherein said diameters of the pins and spacing therebetween is as low as 20 nanometers corresponding to approximately 10 billion pins per square centimeter as the charge transfer density.

5. In an electronic device, a charge transfer plate through which electrical signals are simultaneously transmitted, including an electrically insulating matrix and an array of electrically conductive wires embedded therein, said wires being spaced from each other and having diameters dimensionally providing a cross-sectional charge transfer density substantially exceeding 900,000 wires per square centimeter.

6. The electronic device as defined in claim 5, further including a mirror layer interfaced with said electrically insulating matrix, a light modulation element in abutment with the mirror layer, a charge generating element, and a gain element interfaced between the charge generating element and the electrically insulating matrix in spaced relation to the mirror layer.

7. The electronic device as defined in claim 5, further including adjacent sets of coplanar circuit chips embedded in insulator bodies operatively interconnected by the charge transfer plate.

8. The electronic device as defined in claim 5 further including an enclosure within which a vacuum chamber is formed, said enclosure having an opening within which the charge transfer plate is sealingly mounted in a vacuum-tight manner.

9. In an electronic device having a high density charge transfer plate made of an electrically insulating material and an array of electrically conductive pins embedded therein, the improvement residing in spacing between said pins being as low as 20 nanometers and said electrically insulating material being alumina while the pins are made of indium.

10. In an electronic device, a high density charge transfer plate through which electrical signals are simultaneously transmitted, including an electrically insulating matrix and an array of electrically conductive wires embedded therein, a pair of insulator bodies interfaced with said electrically insulating matrix, electrically conductive inputs interfaced between the insulator bodies and the electrically insulating matrix in spaced relation to each other, and adjacent sets of coplanar circuit chips embedded in said insulator bodies operatively interconnected by the high density charge transfer plate.

* * * * *